US011945621B2

(12) United States Patent
Kowalewski et al.

(10) Patent No.: US 11,945,621 B2
(45) Date of Patent: Apr. 2, 2024

(54) PACKAGING AND A METHOD OF MANUFACTURE THEREOF

(71) Applicant: KRAFT FOODS R & D, INC., Deerfield, IL (US)

(72) Inventors: Alain Kowalewski, Deerfield, IL (US); David Emiro Galavis Borden, Deerfield, IL (US)

(73) Assignee: KRAFT FOODS SCHWEIZ HOLDING GMBH, Zug (CH)

( * ) Notice: Subject to any disclaimer, the term of this patent is extended or adjusted under 35 U.S.C. 154(b) by 30 days.

(21) Appl. No.: 15/501,581

(22) PCT Filed: Jul. 17, 2015

(86) PCT No.: PCT/IB2015/001313
§ 371 (c)(1),
(2) Date: Feb. 3, 2017

(87) PCT Pub. No.: WO2016/027141
PCT Pub. Date: Feb. 25, 2016

(65) Prior Publication Data

US 2017/0217610 A1 Aug. 3, 2017

(30) Foreign Application Priority Data

Aug. 19, 2014 (GB) ..... 1414735

(51) Int. Cl.
*B65B 9/06* (2012.01)
*B65B 9/073* (2012.01)
(Continued)

(52) U.S. Cl.
CPC ..... *B65B 9/06* (2013.01); *B65B 9/073* (2013.01); *B65B 11/004* (2013.01);
(Continued)

(58) Field of Classification Search
CPC ..... B65B 61/02; B65B 23/10; B65B 9/207; B65B 31/045; B65B 51/02;
(Continued)

(56) References Cited

U.S. PATENT DOCUMENTS 3,402,524 A * 9/1968 Griner ..... B65B 23/10 53/550
3,983,680 A * 10/1976 Casutt ..... B65B 23/02 53/397
(Continued)

FOREIGN PATENT DOCUMENTS

CN 1582245 A 2/2005
CN 1675056 A 9/2005
(Continued)

OTHER PUBLICATIONS

JP2004075136A machine translation of description, Kume Satoshi, Packaging Machine, 2004 (Year: 2004).*
(Continued)

*Primary Examiner* — Jacob A Smith
(74) *Attorney, Agent, or Firm* — CANTOR COLBURN LLP

(57) ABSTRACT

The invention provides a method of manufacturing packaging comprising the steps of: a) providing a packaging material (2) comprising cartonboard, semi-rigid plastics or other semi-rigid packaging material; b) forming fold lines (8) and/or cuts within the packaging material (2) by subjecting the packaging material (2) to laser (12) or mechanical scoring; c) folding the packaging material (2) along the fold lines (8) and/or cuts and securing in position to form a substantially tubular container (200); and d) forming at least one seal (302, 304) by sealing together at least two opposing regions (122, 124, 126, 128) of a blank (4) to form an at least partially sealed package (300); e) performing at least one of
(Continued)

steps b), c) and d) on a horizontal or vertical fill, form and seal apparatus (400).

20 Claims, 5 Drawing Sheets

(51) Int. Cl.

| | |
|---|---|
| ***B65B 11/00*** | (2006.01) |
| ***B65B 25/00*** | (2006.01) |
| ***B65B 51/02*** | (2006.01) |
| ***B65B 61/02*** | (2006.01) |
| ***B65D 65/14*** | (2006.01) |
| ***B65D 65/38*** | (2006.01) |
| ***B65D 75/40*** | (2006.01) |
| ***B65D 85/60*** | (2006.01) |

(52) U.S. Cl.
CPC ..... *B65B 25/005* (2013.01); *B65B 51/02* (2013.01); *B65B 61/02* (2013.01); *B65D 65/14* (2013.01); *B65D 65/38* (2013.01); *B65D 75/40* (2013.01); *B65D 85/60* (2013.01); *B65B 2220/00* (2013.01); *B65B 2220/08* (2013.01)

(58) Field of Classification Search
CPC ..... B65D 75/5838; B65D 2575/586; B65D 2577/2033; B65D 2577/205; B65D 2577/2091; B29C 66/8122; B29C 65/00
USPC ..... 53/450, 451, 452, 456, 457, 458, 558, 53/563, 564, 566
See application file for complete search history.

(56) References Cited

U.S. PATENT DOCUMENTS

| | | | | |
|---|---|---|---|---|
| 4,819,414 | A * | 4/1989 | Worden | B29C 66/4312 53/550 |
| 4,924,659 | A * | 5/1990 | Watanabe | B65B 51/303 53/550 |
| 5,050,368 | A * | 9/1991 | Noh | B65B 61/02 53/442 |
| 5,282,349 | A * | 2/1994 | Siegel | B29C 66/7234 53/433 |
| 5,301,491 | A * | 4/1994 | Boardman, Jr. | A47C 4/02 53/428 |
| 6,148,589 | A * | 11/2000 | Fukui | B65B 9/073 53/135.1 |
| 6,195,967 | B1 * | 3/2001 | Todd | B65B 1/02 53/562 |
| 6,349,525 | B1 * | 2/2002 | Veith | A47K 10/421 53/117 |
| 6,357,212 | B1 * | 3/2002 | Salm | B65B 59/001 53/376.4 |
| 6,629,400 | B1 * | 10/2003 | Offermann | B29C 66/9241 53/374.6 |
| 7,870,705 | B2 * | 1/2011 | Wood | B65B 9/02 53/399 |
| 8,616,768 | B2 * | 12/2013 | Inagaki | B65B 9/073 383/120 |
| 8,707,660 | B2 * | 4/2014 | Howes | B65B 9/20 53/450 |
| 8,800,250 | B2 * | 8/2014 | Moehlenbrock | B65B 61/18 53/452 |
| 8,875,478 | B2 * | 11/2014 | Fitzgerald, IV | B65B 43/06 53/455 |
| 9,162,786 | B2 * | 10/2015 | Sanfilippo | B65D 21/0209 |
| 9,688,442 | B2 * | 6/2017 | Lyzenga | B65B 9/06 |
| 2005/0238766 | A1 * | 10/2005 | Henderson | B65B 61/007 426/106 |
| 2005/0252175 | A1 | 11/2005 | Martin | |
| 2006/0163335 | A1 | 7/2006 | Pokusa et al. | |
| 2008/0041750 | A1 * | 2/2008 | Kohlweyer | B65D 75/5838 206/438 |
| 2008/0160249 | A1 * | 7/2008 | Makino | B65D 71/72 428/116 |
| 2009/0127323 | A1 * | 5/2009 | Zeiler | B29C 66/83533 229/116 |
| 2010/0043352 | A1 * | 2/2010 | Hashimoto | B29C 66/3472 53/375.9 |
| 2011/0120059 | A1 * | 5/2011 | Andreotti | B29C 66/84121 53/451 |
| 2011/0131935 | A1 * | 6/2011 | Kondo | B65B 9/2042 53/576 |
| 2011/0213092 | A1 * | 9/2011 | Boyce | C09J 133/00 525/310 |
| 2012/0196730 | A1 * | 8/2012 | Steele | B65D 75/5827 493/224 |
| 2013/0011527 | A1 * | 1/2013 | Renders | B65D 75/5838 426/124 |
| 2013/0017940 | A1 * | 1/2013 | Bonariva | B31B 50/14 493/59 |
| 2013/0059709 | A1 * | 3/2013 | Miyamoto | B29C 66/1122 493/186 |
| 2013/0114918 | A1 * | 5/2013 | Lyzenga | B65B 61/184 383/203 |
| 2013/0121624 | A1 * | 5/2013 | Lyzenga | B65D 75/5838 383/203 |
| 2013/0177263 | A1 * | 7/2013 | Duan | B65D 75/5833 428/212 |
| 2013/0248587 | A1 * | 9/2013 | Bouline | B65D 75/5838 229/122 |
| 2014/0041342 | A1 * | 2/2014 | Van Den Elzen | B65B 25/005 53/450 |
| 2014/0069061 | A1 * | 3/2014 | Anzini | B65D 33/2533 53/450 |
| 2014/0079343 | A1 * | 3/2014 | Lyzenga | B65D 75/5838 383/203 |
| 2014/0185965 | A1 | 7/2014 | Lyzenga | |
| 2014/0190125 | A1 * | 7/2014 | Rearick | B65B 31/06 53/562 |
| 2014/0228194 | A1 * | 8/2014 | Kepinski | B65B 47/10 493/227 |
| 2014/0299494 | A1 * | 10/2014 | Rossiter | B32B 38/0012 206/308.2 |

FOREIGN PATENT DOCUMENTS

| | | | | |
|---|---|---|---|---|
| CN | 1833861 | A | 9/2006 | |
| EP | 0905032 | A1 | 3/1999 | |
| EP | 1914168 | A1 | 4/2008 | |
| EP | 2360099 | A1 | 8/2011 | |
| EP | 2644529 | A1 | 10/2013 | |
| FR | 2923747 | A1 * | 5/2009 | B65B 9/213 |
| FR | 2923747 | A1 | 5/2009 | |
| JP | 2004075136 | A * | 3/2004 | |
| JP | 2004075136 | A * | 3/2004 | B65B 9/2021 |
| JP | 2004075136 | A | 3/2004 | |
| WO | 2013144699 | A1 | 10/2013 | |
| WO | WO-2014002713 | A1 * | 1/2014 | B65B 9/207 |

OTHER PUBLICATIONS

Chinese First Office Action with English Translation; Application No. 201580043858.9; dated May 22, 2018; pp. 1-13.
International Search Report; International Application No. PCT/IB2015/001313; International Filing Date: Jul. 17, 2015; dated Oct. 1, 2015; 7 Pages.
Search Report under Section 17; Great Britain Application No. 1414735.9; Date of Search: Mar. 2, 2015; 1 Page.
Written Opinion of the International Searching Authority; International Application No. PCT/IB2015/001313; International Filing Date: Jul. 17, 2015; dated Oct. 1, 2015; 7 Pages.

* cited by examiner

PACKAGING AND A METHOD OF MANUFACTURE THEREOF

CROSS REFERENCE TO RELATED APPLICATIONS

This application is a National Stage application of PCT/IB2015/001313, filed Jul. 17, 2015, which claims the benefit of Great Britain Application No. 1414735.9, filed Aug. 19, 2014, both of which are incorporated by reference in their entirety herein.

TECHNICAL FIELD OF THE INVENTION

The present invention relates to cartonboard-based packaging and methods for the production thereof.

BACKGROUND TO THE INVENTION

It is known to provide so-called flow-wrap packaging which consists of a flexible container comprising front and back panels, side panels, and sealed at either end, normally with crimping or embossing to provide patterned sealing portions.

In general, this type of flow-wrap packaging is manufactured by horizontal or vertical form, fill and seal processes (HFFS or VFFS). In horizontal fill, form and seal processes flexible packaging film is run through machinery which folds the material around a product and then clamps and seals the ends of the folded material followed by cutting, to provide a sealed packaging. Such packaging can be run through appropriate machinery relatively rapidly, in order to produce many filled packages per minute. Examples of such machinery include the Pack 401 Horizontal Flow Wrapper supplied by Bosch GmbH, Germany and the Horizontal Form Fill Seal Packaging Machine 8000 MH supplied by Ossid, USA.

Conversely, there are many types of cartonboard-based packaging which are formed from cartonboard blanks, and folded to provide a packaging container which may then be sealed by appropriate means. Examples of cartonboard (also known as "cardboard" or "card") packaging include standard cartonboard boxes, shelf-ready packaging and the like for example.

Up to now, it has not been thought possible to manufacture cartonboard-based packaging using standard horizontal or vertical form, fill and seal processes.

It would therefore be advantageous to provide a method for the manufacture of cartonboard-packaging using standard horizontal or vertical form, fill and seal processes whilst being economical and simple to produce from cartonboard blanks, preferably using standard cartonboard packaging materials.

It would also be advantageous to provide a method for the manufacture of cartonboard-packaging which mimics the shape and appearance of standard flow-wrap packaging, whilst being economical and simple to produce from cartonboard blanks.

In addition, it would be advantageous to provide a method for the manufacture of cartonboard packaging in which the crimped or patterned end fin portions of flow-wrapped packaging are present, in order to provide a generally authentic flow-wrap look to the cartonboard packaging.

It is therefore an aim of embodiments of the present invention to overcome or mitigate at least some of the problems of the prior art.

SUMMARY OF THE INVENTION

According to a first aspect of the present invention there is provided a method of forming packaging comprising the steps of:

a) providing a packaging material comprising cartonboard, semi-rigid plastics or other semi-rigid packaging material, or any combination thereof;
b) forming fold lines and/or cuts within the packaging material by subjecting the packaging to laser or mechanical scoring;
c) folding the packaging material along the fold lines and/or cuts and securing in position to form a substantially tubular container; and
d) forming at least one seal by sealing together at least two opposing regions of the packaging material to form a package which is at least partially sealed.

wherein at least one of steps b), c) and d) is performed on a horizontal or vertical fill, form and seal apparatus.

In some embodiments at least steps c) and d) are performed on a horizontal or vertical fill, form and seal apparatus, and in other embodiments each of b), c) and d) are performed on a horizontal or vertical fill, form and seal apparatus.

The horizontal fill, form and seal apparatus may be a horizontal flow-wrap apparatus.

The term "semi-rigid packaging material" is intended to cover any material presently deemed unsuitable for conventional horizontal or vertical fill, form and seal flow-wrapping processes due to its stiffness. In preferred embodiments the packaging material comprises cartonboard, plastics or a combination thereof (including laminates thereof).

According to a second aspect of the present invention there is provided a method of forming packaging comprising the steps of:

a) providing a packaging material comprising cartonboard or a plastics material having a thickness of at least 125 microns;
b) forming fold lines and/or cuts within the packaging material by subjecting the packaging material to laser or mechanical scoring;
c) folding the packaging material along the fold lines and/or cuts and securing in position to form a substantially tubular container; and
d) forming at least one seal by sealing together at least two opposing regions of the packaging material to form a package which is at least partially sealed, wherein at least one of steps b), c) or d) is performed on a horizontal or vertical fill, form and seal apparatus.

In some embodiments at least steps c) and d) are performed on a horizontal or vertical fill, form and seal apparatus, or each of b), c) and d) are performed on a horizontal or vertical fill, form and seal apparatus.

The packaging material may comprise cartonboard having an average fibre length of 0.5 mm to 15 mm, or from 0.7 mm to 12 mm. In some embodiments the cartonboard has an average fibre length of at least 0.5 mm, 0.6 mm, 0.7 mm or 0.8 mm. In some embodiments the cartonboard has an average fibre length of no more than 20 mm, 1.8 mm, 16 mm, 14 mm or 12 mm. The cartonboard may comprise fibres having a substantially flat ribbon shape, cylindrical shape or any other suitable shape. The cartonboard may comprise fibres having a diameter of between 10 microns and 100 microns, such as between 15 microns and 60 microns. Fibre lengths, shapes and diameters within these preferred parameter ranges provide the correct balance of flexibility of the material when suitably scored using the methods of the present invention, for passing through horizontal or vertical fill form and seal apparatus, whilst maintaining enough strength to form the required packaging.

In some embodiments the method may comprise providing a packaging material consisting essentially of cartonboard, but may include minor amounts of other materials such as a laminated film on one or both sides thereof, printed material or the like, for example.

The term "semi-rigid packaging material" is intended to cover any material presently deemed unsuitable for conventional horizontal or vertical fill, form and seal flow-wrapping processes due to its stiffness. In preferred embodiments the unsuitable packaging material referenced above comprises cartonboard, plastics or a combination thereof (including laminates thereof).

In some embodiments step b) of the method may comprise forming individual blanks by forming fold lines and/or cuts within the packaging material.

In some embodiments the method comprises forming a plurality of connected packages from the packaging material, which may be connected along at least a portion thereof. In such embodiments the method may further comprise separating the plurality of formed packages, for example, by cutting along their connected portions. The connected portions may comprise adjacent sealed portions of connected packages.

The plurality of packages may be formed from a sheet or roll of packaging material.

In some embodiments the method may comprise forming the blank separately before loading onto apparatus used in conventional horizontal or vertical fill, form and seal processes.

The fold lines and/or cuts may be formed within the packaging material during a horizontal or vertical fill, form and seal process. In some embodiments the fold lines and/or cuts are formed within the packaging material before an item is located on the packaging material. In other embodiments the fold lines and/or cuts are formed within the packaging material after an item is located on the packaging material. In further embodiments at least one fold line and/or at least one cut is formed within the packaging material before an item is located on the packaging, and at least one fold line and/or at least one cut is formed within the packaging material after an item is located on the packaging material.

In some embodiments the method may comprise providing a continuous sheet or roll of packaging material upon which a plurality of blanks may be formed. In such embodiments the method may comprise dividing the packaging material into individual blanks separately before loading onto apparatus used in conventional horizontal or vertical fill, form and seal processes.

In other embodiments the method may comprise loading the continuous sheet or roll onto the apparatus which may further comprise a means to divide the sheet into individual blanks during the manufacturing process.

The packaging material may be cut into individual blanks by means of laser or mechanical scoring as with the formation of the fold lines. In some embodiments the fold lines are formed by laser scoring and the packaging material is divided into individual blanks by means of mechanical scoring.

The at least one seal may be formed by providing an adhesive on at least a portion of at least one of the regions of the packaging material. The adhesive may comprise a peelable or reclosable adhesive. The at least one seal may be formed by way of a peelable adhesive, which may be re-sealable adhesive, such as a heat-sensitive adhesive, a cold seal adhesive, or the like, for example. In alternative embodiments, or in addition to use of an adhesive, the seal may be formed from a weld, such as a peelable weld.

In other embodiments the at least one seal may be formed by mechanically, sealing the at least two regions of the packaging material. The mechanical seal may comprise as a zip lock, finger press sealing strip, grip seal or the like, for example.

The at least one seal may comprise a fin seal formed by sealing together the at least two opposing surfaces of the packaging material.

The method may comprise crimping or embossing the at least one seal along at least a portion thereof to form patterned sealed regions of the packaging. In some embodiments the method comprises crimping or embossing the at least one seal along substantially the whole length of the or each seal. Crimping or embossing the sealed regions, in addition to the configuration of the overall structure of the packaging enables the cartonboard packaging to look identical or substantially identical to equivalent polymeric flow-wrap packaging formed by conventional horizontal or vertical fill, form and seal processes.

The method may comprise forming a packaging housing at least one item therein. In some embodiments the method comprises placing at least one item on an inside surface of the blank before folding the blank along the formed fold lines to form the tubular container. In other embodiments at least one item may be placed in the tubular container formed after folding the packaging material along the fold lines.

In yet further embodiments the method may comprise placing at least one item into a partially sealed package after the at least one seal has been formed. In such embodiments, the method may comprise forming a first seal by sealing together at least two regions of the packaging material, placing at least one item into the partially sealed package, and subsequently forming a second seal by sealing together at least two further regions of the packaging material. By forming the first and second seal, the method may comprise forming a fully sealed packaging housing at least one item therein.

The at least one item may be a food item, which may comprise a secondary packaging such as a wrapper or the like, for example. The food item may be a confectionery item, bakery item, fruit, vegetable, meat, cheese, snack item, or the like. Suitable confectionery items include chocolate, chocolate products, candy, chewing gum or a combination thereof, for example. Suitable bakery items may include biscuits, cookies, chips, crisps, dough-based products or the like. There may be a single food item or a plurality of food items, and there may be a combination of different food items, such as a combination of confectionery and bakery items, or of different confectionery items, for example. In some embodiments the food item is a block or bar of chocolate.

According to a third aspect of the invention there is provided a packaging manufactured using the method according to the first or second aspect of the present invention comprising at least one set of opposing and spaced apart first and second surfaces, wherein a region of each end the first and second surfaces is sealed together.

In preferred embodiments the packaging material comprises cartonboard, plastics or any combination thereof (including laminates).

In some embodiments the packaging may be formed from a material consisting essentially of cartonboard, but may include minor amounts of other materials such as a laminated film on one or both sides thereof, printed material or the like, for example.

The at least one sealed region may comprise a fin seal, for example. In such embodiments the fin seal/s may be crimped or embossed along at least a portion thereof to form patterned sealed regions of the packaging. In this way, the packaging may be made to look identical or substantially identical to equivalent polymeric flow-wrap packaging formed by conventional horizontal or vertical fill, form and seal processes formed from a non-rigid material.

DETAILED DESCRIPTION OF THE INVENTION

In order that the invention may be more clearly understood an embodiment thereof will now be described, by way of example only, with reference to the accompanying drawings, in which.

A method in accordance with the present invention will now be described with reference to FIGS. 1-4.

Figure 1:
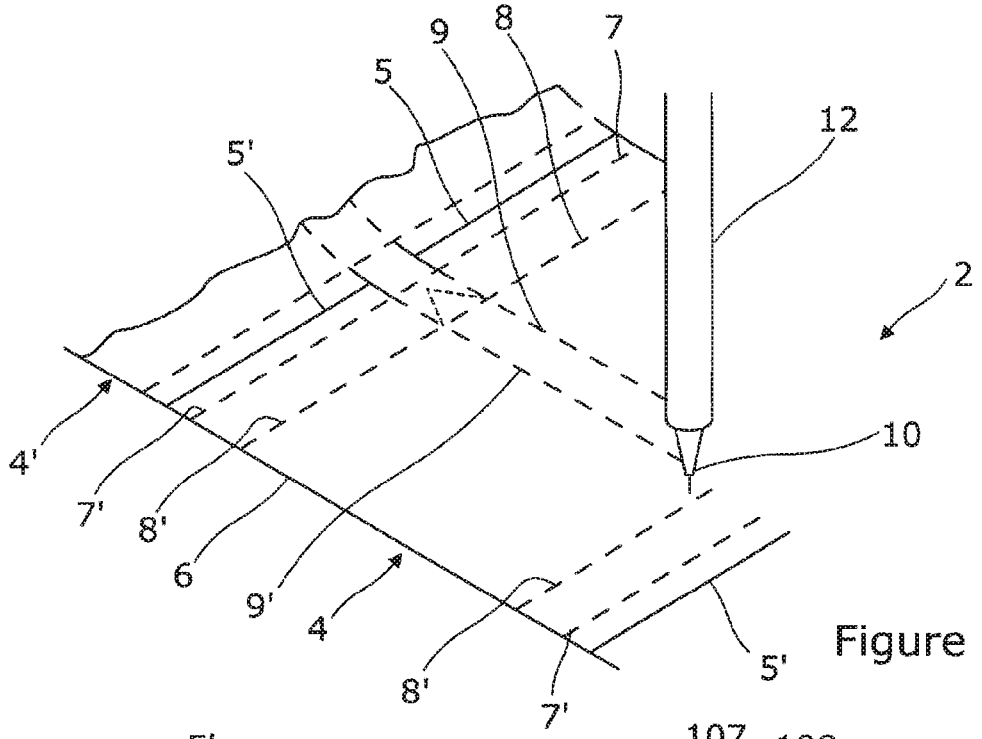
FIG. 1 is a perspective view of the scoring stage of a method in accordance with the present invention.

Initially, a sheet of packaging material 2 is provided. In the illustrated embodiment the sheet of packaging material 2 comprises cartonboard having a thickness of around 205 microns. However, other forms of semi-rigid material may be used. Blanks 4, 4' are formed in the sheet of packaging material 2 and are defined by edges 5, 6 as illustrated in FIG. 1. Fold lines (shown as dotted lines 8) are formed within the packaging material 2. The fold lines 8 are formed in the sheet 2 using laser light 10 from a laser cutter 12. Although the illustrated method uses a laser cutter 12, it should be appreciated that other means of forming fold lines 8 in the sheet 2 may be employed including mechanical creasing, such as die-cutting for example.

In this embodiment, the individual blanks 4, 4' remain connected along the edges 5, 5' however, it is envisaged that in some embodiments the blanks 4, 4' may be separated by forming cuts in the packaging material 2 along the edges 5, 6. The cuts 5, 6 may also be formed in the sheet 2 using laser light 10 from a laser cutter 12.

Figure 2:
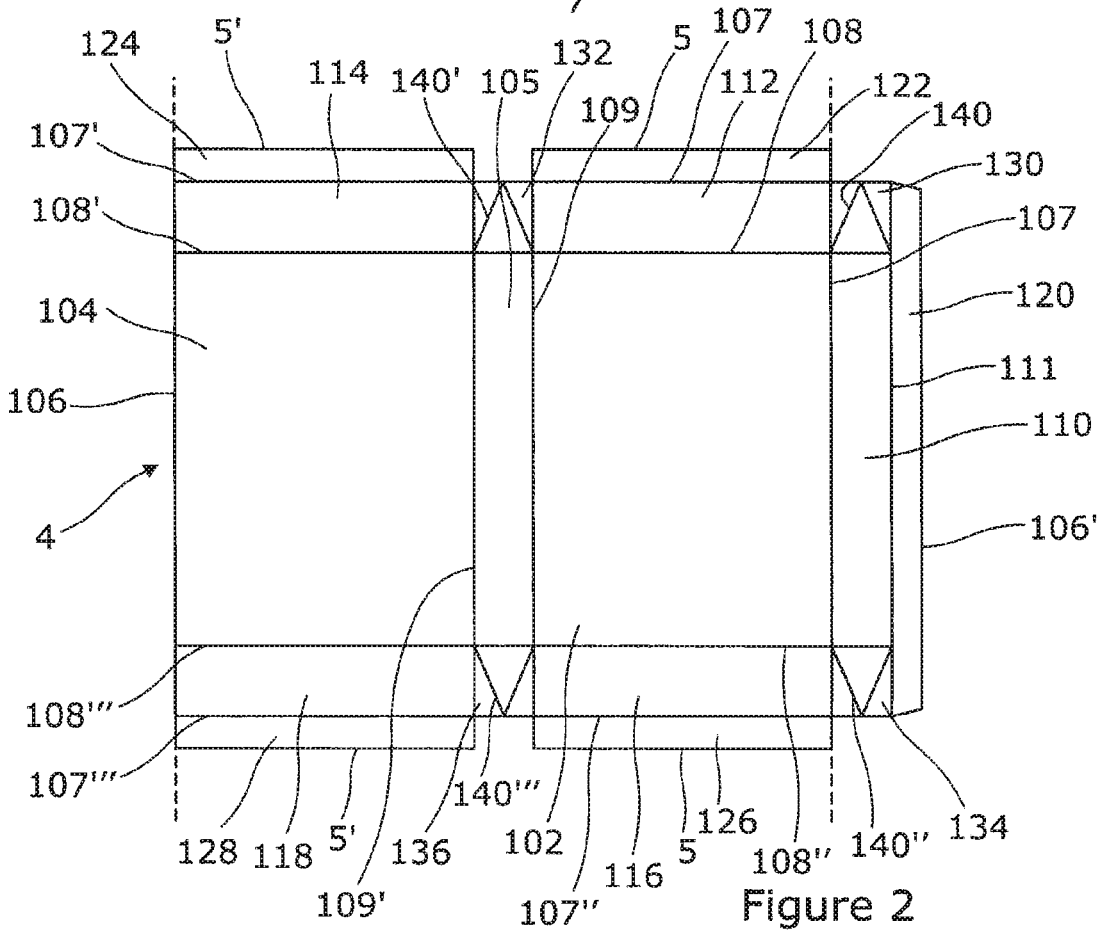
FIG. 2 illustrates an embodiment of a blank produced by a method in accordance with the present invention.

FIG. 2 illustrates an embodiment of an individual blank 4 as produced by the scoring stage shown in FIG. 1. The completed blank 4 includes front panel 102 and a back panel 104 each comprising opposite longitudinal edges. Extending between the edges of the front and back panels 102, 104 is a first side panel 105 integrally formed with front and back panels 102, 104 and connected by fold lines 109, 109'. Integrally formed with the opposite edge of the front panel 102 to which the first side panel 105 is connected is a second side panel 110 extending therealong, connected to the front panel 102 by fold line 107. Integrally formed with the opposite edge of the second side panel 110 to which the front panel 102 is connected is a securement tab 120. The securement tab 120 is connected to the edge of the second side panel 110 by fold line 111.

At the longitudinal ends of the front panel 102 and the back panel 104 are end regions 112, 114 at a first end, and end regions 116, 118 at the opposite end. The end regions 112, 114, 116, 118 are defined on the front 102 and rear 104 panels by respective fold lines 108, 108', 108", 108'". Integrally formed with each end region 112, 114, 116, 118 are respective sealing regions 122, 124, 126, 128 connected to their respective end region 112, 114, 116, 118 by fold lines 107, 107', 107", 107'". The sealing regions 122, 124, 126, 128 extend outwardly from their respective end regions 112, 114, 116, 118.

The first side panel 105 and second side panel 110 are provided with end regions 130, 132, 134, 136 at the ends thereof. End regions 132, 136 are located adjacent to the end regions 112, 114 and end regions 116, 118 respectively of the front and rear panels 102, 104. End regions 130, 134 are located adjacent end region 112 and end region 116 respectively of the front panel 102. Furthermore, each side panel end region 130, 132, 134, 136 includes a triangular fold-line assembly 140, 140', 140", 140'".

After forming blanks 4, 4' etc. within the packaging material 2, the packaging material 2 is subsequently folded to form a tubular container 200 as illustrated in FIG. 1. Container 200 is formed by folding along the fold lines formed in the packaging material 2 which defines the panels 102, 104, 105, 110 of the blanks 4, 4' etc. The fold lines are folded in a constant direction and the defined securement tab 120 is secured to an inner surface of back panel 104. The folding of the packaging material 2 to form the tubular container 200 results in sealing regions 122, 126 of the front panel 102 of each blank 4, 4' etc. being positioned opposite to the respective sealing regions 124, 128 of the back panel 104.

Figure 3:
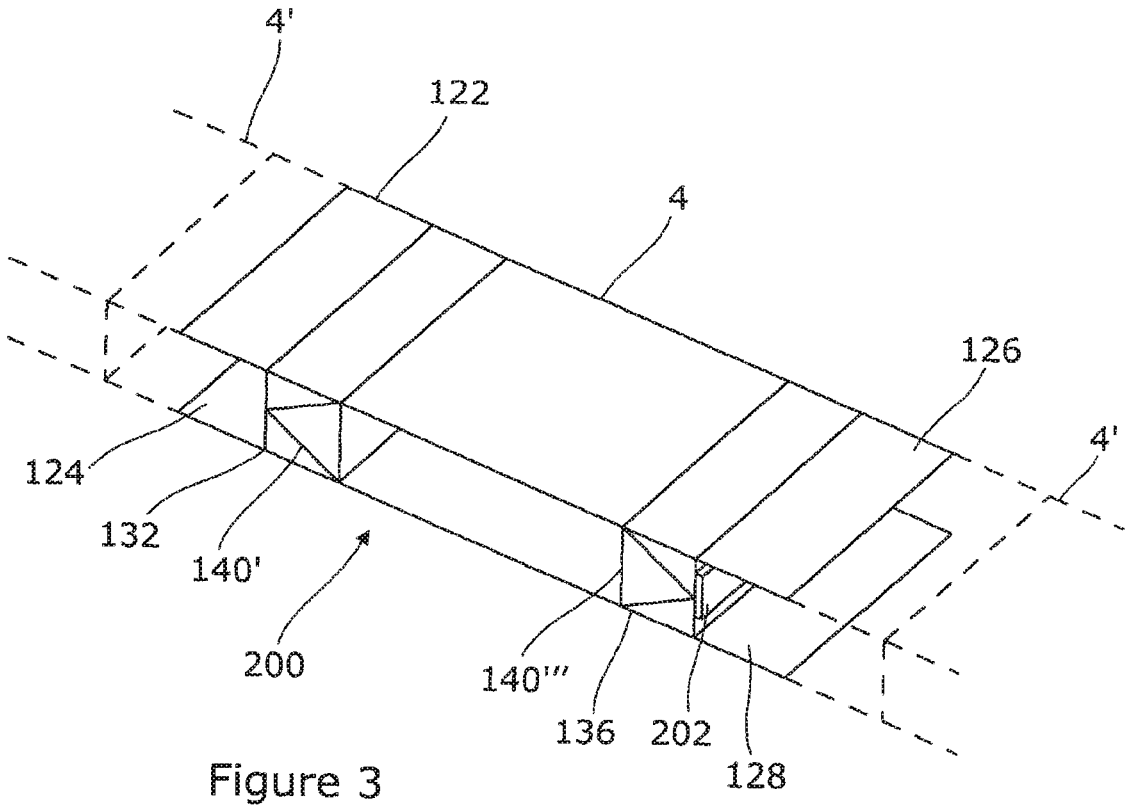
FIG. 3 is a perspective view of the folding stage of a method in accordance with the present invention.

FIG. 3 further illustrates the position of a product 202 within the tubular container 200. The product 202 is located on an inner surface of either the front panel 102 or the back panel 104 of a blank 4 prior to folding the packaging material using the abovementioned method. In doing so, the packaging material 2 may be folded about the product 202 to form a tubular container 200 housing the product 202. In the illustrated embodiment, the tubular container 200 comprises a plurality of connected blanks 4, 4'. In such embodiments, there is provided a product 202 on a panel 102, 104 of each blank 4, 4' formed in the packaging material 2. In this way, the tubular container 200 encloses a plurality of products 202.

The method described above mimics conventional flow-wrapping methods. However, it is envisaged that the product 202 may be located within the tubular container 200 subsequent to it being formed by slotting the product 202 into an open end of the container 200.

To complete the wrapping process, and in doing so forming a packaging 300, adjacent surfaces of sealing regions 122, 124 and sealing regions 126, 128 are sealed together to form sealed end regions.

To assist in the sealing of sealing regions 122, 124, 126, 128, an adhesive strip is applied to at least one of the sealing regions 122, 124 and to at least one of sealing regions 126, 128. The adhesive strip may be applied to the blank 4 prior to folding the packaging material 2, or applied to the sealing regions 122, 124, 126, 128 of each blank 4, 4', after forming the tubular container 200 from the packaging material 2. The adhesive strip 200 may comprise a hot melt adhesive or other suitable adhesive. In other embodiments the sealing regions are heat welded without the use of an adhesive.

This process is repeated for the sealing regions of each blank 4, 4' (see FIG. 4) which is formed in the packaging material 2. In this way, the tubular container 200 now comprises a series of connected sealed compartments each enclosing a single product 202. To form the packaging 300, as illustrated in FIG. 3, the series of sealed compartments are separated by, forming cuts across adjacent sealed regions of adjacent sealed compartments.

The formed packaging 300 encloses a single product 202 and comprises sealed end regions in the form of fin seals 302, 304. The formed packaging also includes gabled end regions 306, 308, 310, 312. The gabled end regions 306, 308, 310, 312 are formed during the sealing of the regions 122, 126 and 124, 128 by folding end regions 130, 132, 134, 136 of the first and second side panels 105, 110 about their respective triangular fold-line assemblies 140, 140', 140", 140'". The triangular fold line assemblies 140, 140', 140", 140'" enable the folding of the end regions 130, 132, 134, 136 without affecting the orientation of the first and second side panels 105, 110 which remain substantially perpendicular to the front panel 102 and rear panel 104. In this way, a packaging 300 is formed enclosing a product 202 therein comprising a configuration which mimics conventional flow-wrapped packaging. The packaging 300 maybe decorated in any suitable manner with branding and artwork, which will enable masking the cartonboard appearance, further helping to give the packaging the impression of being produced in a flow-wrap process.

As the sealing regions 122, 124, 126, 128 are secured together, they may also be embossed using suitable sealing jaw patterns, in order to provide an embossed pattern. In alternative embodiments, an image of an embossing pattern may be printed on the sealing regions 122, 124, 126, 128 in place of actual embossing of the regions.

In some embodiments, the packaging material 2 may be separated into individual blanks 4, 4' etc. by forming cuts along edges 5 and 6 before the packaging material 2 is folded about the products 202. It is envisaged that the individual blanks 4, 4' may be loaded onto a conventional horizontal or vertical fill, form and seal process apparatus after being divided, rather than loading a sheet of packaging material 2 onto the apparatus and subsequently dividing a formed tubular container.

Figure 5:
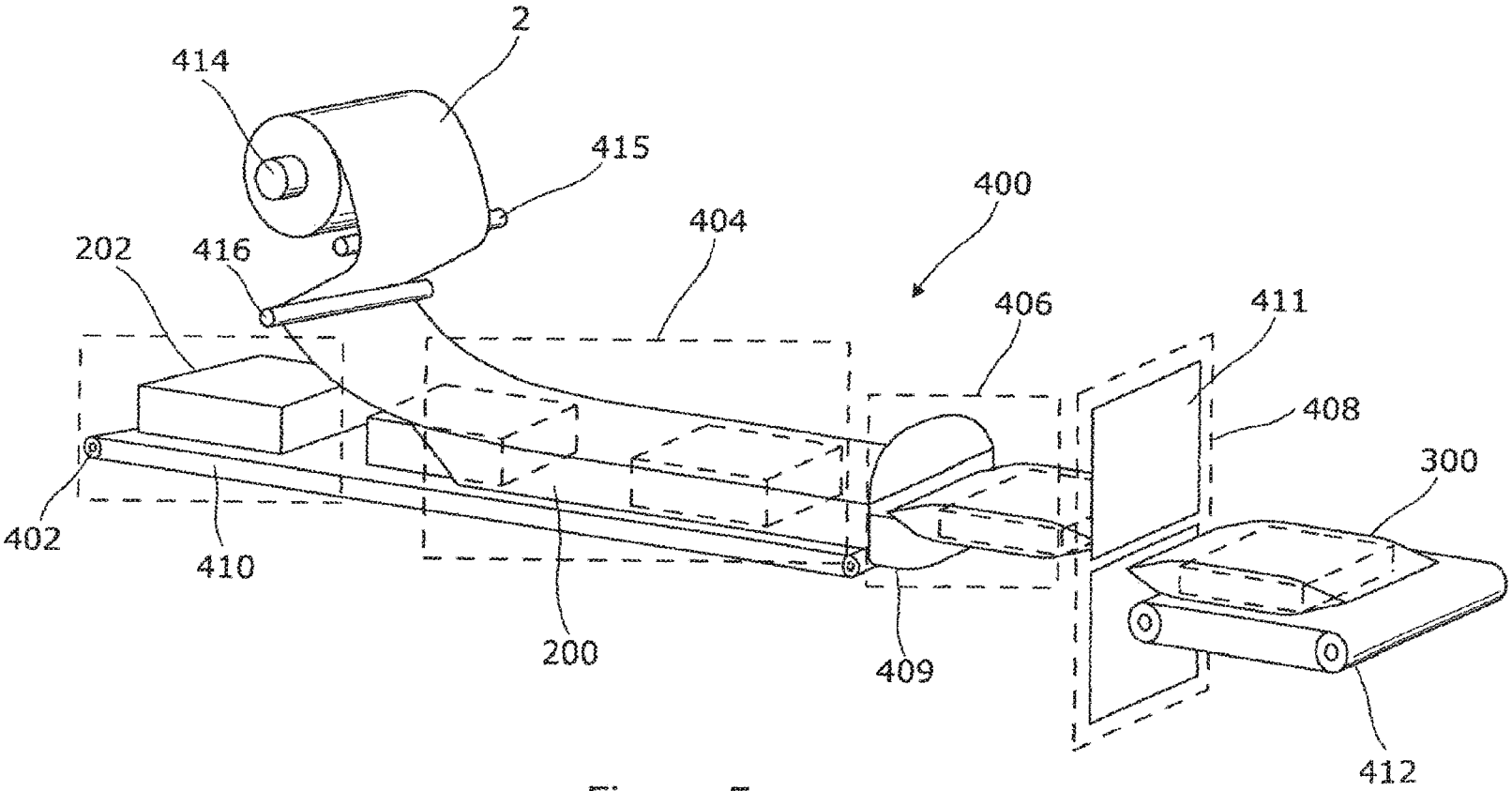
FIG. 5 is a schematic diagram of a horizontal fill, form and seal apparatus which may be used to perform the method in accordance with the present invention.

FIG. 5 illustrates a conventional horizontal fill, form and seal apparatus 400 which may be used to perform the method in accordance with the present invention. The apparatus 400 comprises a loading station 402, wrapping station 404, sealing station 406 and cutting station 408.

Loading station 402 comprises a conveyor 410 operable in use to transport items 202. Sealing station 406 includes a clamp 409 operable in use to aid in the sealing of surfaces of packaging material 2. Cutting station 408 includes a guillotine 411 operable in use to form cuts within the packaging material 2 to divide the packaging material 2 into individual packages.

In use, the apparatus 400 is initially loaded with packaging material 2. In the illustrated embodiment, the packaging material 2 has been subjected to laser scoring prior to being loaded onto the apparatus 400. The laser scoring is performed by a laser cutter which forms fold lines and/or cuts within the packaging material 2 (in accordance with the method illustrated by FIG. 1).

The packaging material is loaded onto the apparatus 400 and wrapped around driving cylinders 414, 415, 416. The driving cylinders 414, 415, 416 are operable in use to move the packaging material 2 through the apparatus 400.

Initially, the sheet of packaging material 2 is moved through the wrapping station 404 where it is wrapped around products 202 located on the conveyor 402. The packaging material 2 is subsequently sealed along an edge such that it forms a partially sealed tubular container 200 (as illustrated in FIG. 3) enclosing a plurality of products 202. The tubular container 200 is then passed through the sealing station 406 wherein the regions of the tubular container 200 between adjacent products 202 are sealed together. This is achieved using clamp 409 which applies pressure to the outer surfaces of the tubular container 200. Applying pressure to the outer surfaces of tubular container 200 activates pressure sensitive adhesives (not shown) located on at least one inner surface of the tubular container 200. The adhesives may be applied prior to loading the packaging material 2 onto the apparatus 400, such as during the scoring of the packaging material 2, or within the sealing station 406 itself.

The tubular container 200, having sealed regions between the locations of adjacent products 202 is subsequently passed through the cutting station 408. The cutting station 408 divides the container 200 into formed packages 300 by cutting transversely across the container 200 along adjacent sealed regions. This forms a package 300 enclosing a product 202 having sealed end regions The apparatus 400 further comprises a second conveyor 412 operable in use to transport the formed packaging 300 away from the cutting station 408.

Figure 4:
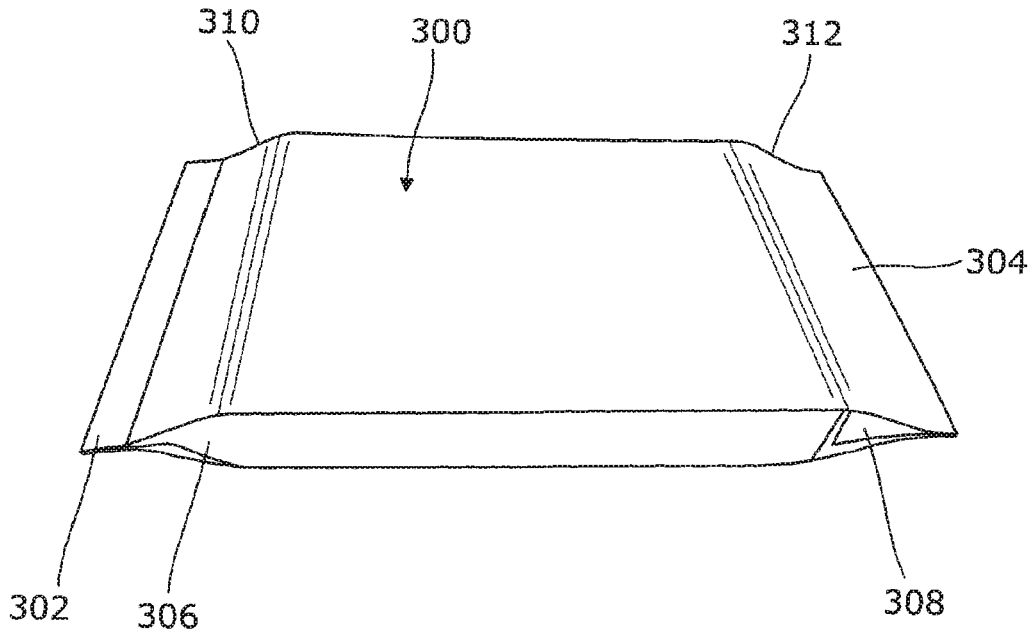
FIG. 4 is a perspective view of an embodiment of the packaging of the present invention.

In the embodiment of the apparatus 400 shown in FIG. 4, the packaging material 2 is scored prior to loading the packaging material 2 onto the apparatus 400. However, it is envisaged that other embodiments of the apparatus may be employed to perform the claimed method wherein there is provided a scoring station operable in use to form fold lines and/or cuts within the packaging material 2 and forms part of the apparatus 400. The scoring station may be located after driving cylinders 414, 415, 416, for example.

Figure 6:
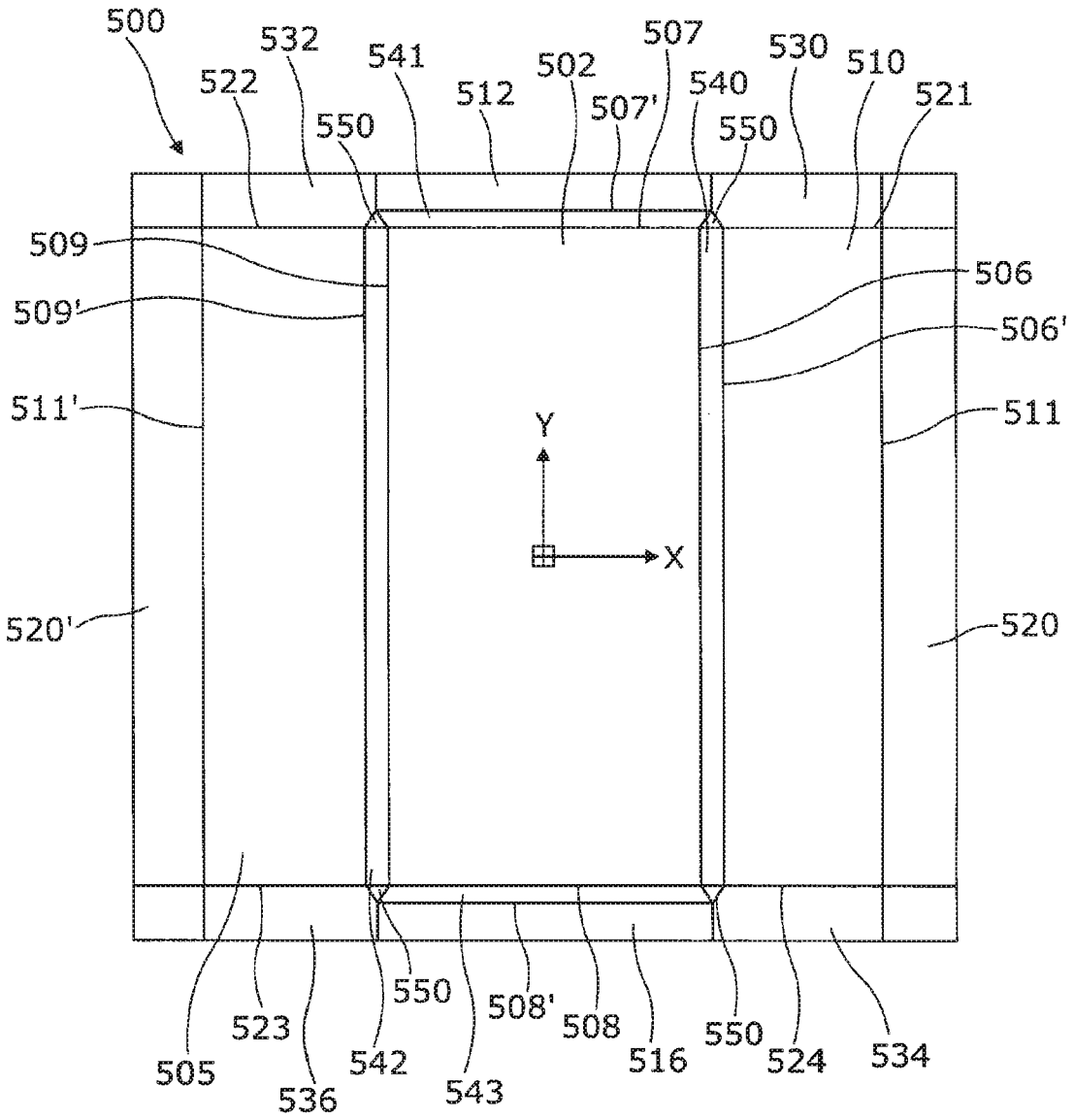
FIG. 6 illustrates a further embodiment of a blank produced by a method in accordance with the present invention.

A further embodiment of a blank 500 as produced using a method in accordance with the present invention is illustrated in FIG. 6. The blank 500 includes a front panel 502 having opposite longitudinal edges. Extending along a first edge of the front panel 502 is a first side panel 505 integrally formed with front panel 502 and connected by connecting region 540. The connecting region 540 is formed integrally with the front panel 502 and side panel 505 along opposing edges by fold lines 506, 506'. Integrally formed with the opposite edge of the front panel 502 to which the first side panel 505 is connected is a second side panel 510 extending there along, connected to the front panel 502 by a second connecting region 542. The connecting region 542 is formed integrally with the front panel 502 and side panel 510 along opposing edges by fold lines 509, 509'. Integrally formed with the opposite edges of the first and second side panels 505, 510 to which the front panel 502 is connected are sealing tabs 520, 520'. The sealing tabs 520, 520' are connected to the edges of the first and second side panels 505, 510 by respective fold lines 511, 511'.

At the longitudinal ends of the front panel are end regions 512, 516. The end regions 512, 516 are connected to the front 502 panel by third and fourth connecting regions 541, 543. The connecting regions 541, 543 are formed integrally with the front panel 502 and respective end regions 512, 516 along opposing edges which are defined by fold lines 507, 507', 508, 508'.

The first side panel 505 and second side panel 510 are provided with end regions 530, 532, 534, 536 at the ends thereof. End regions 530, 532 are located adjacent to the end region 512 and end regions 534, 536 are located adjacent end region 516. Furthermore, there is also provided triangular fold line assemblies 550 connecting each of the connecting regions 540, 541, 542, 543.

The blank 500 illustrated in FIG. 6 may be used in the same way as described above with reference to FIG. 5. The blank 500 is specifically designed to be used to wrap products which have a triangular cross section, rather than those with a rectangular cross section as illustrated in FIG. 5.

Figure 7:
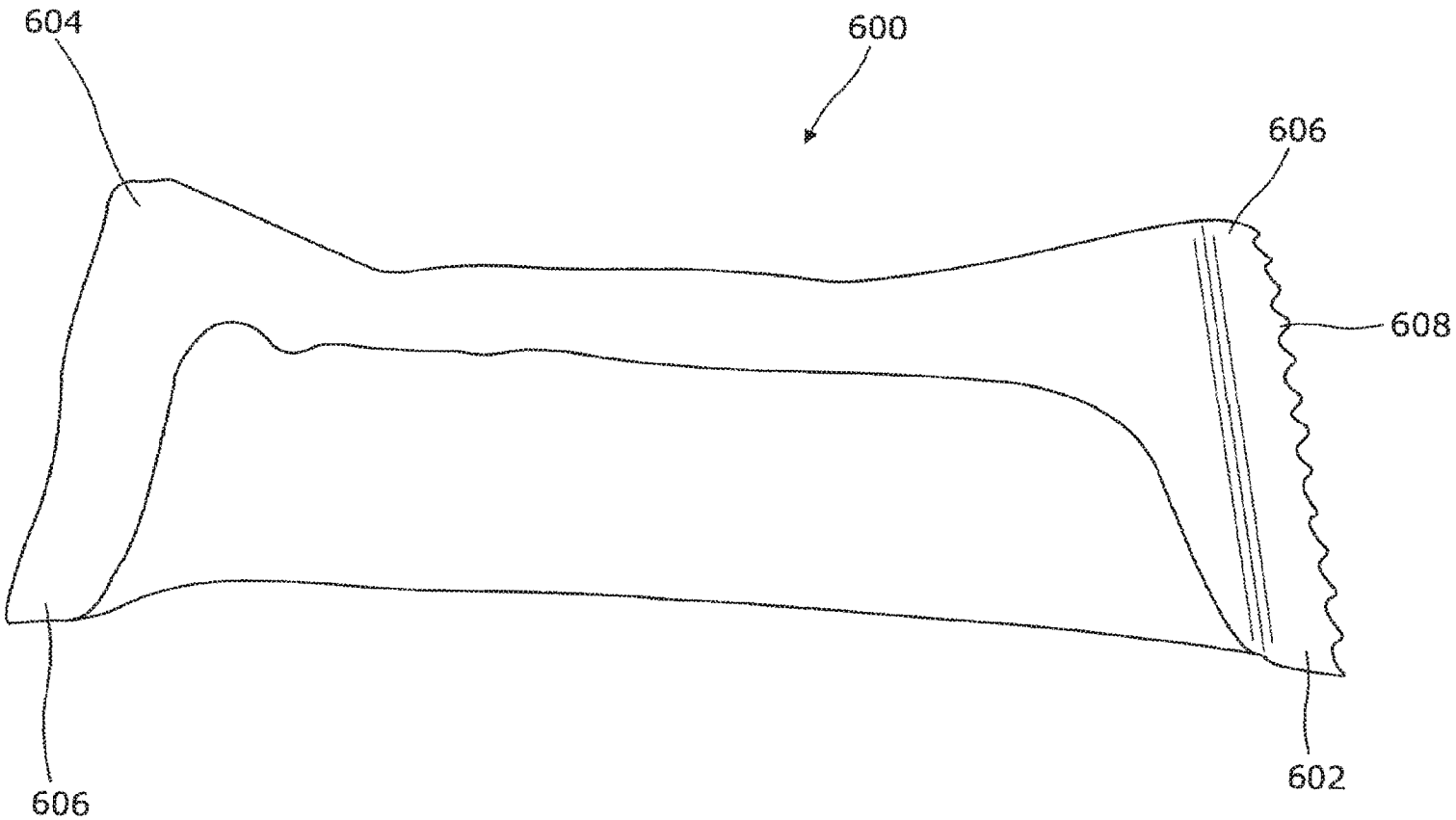
FIG. 7 is a perspective view of an embodiment of the packaging of the present invention formed from the blank illustrated in FIG. 6.

FIG. 7 illustrates an embodiment of a packaging 600 formed using the blank as shown in FIG. 6. The packaging 600 encloses a single product which comprises a triangular cross section and includes sealed end regions in the form of fin seals 602, 604. The embodiment of the packaging 600 illustrated in FIG. 7 also comprises embossing applied to the fin seals 602, 604 for decorative purposes. Furthermore, fin seals 602 further includes cut out regions 608 located along an edge, also for decorative purposes.

The above embodiments are described by way of example only. Many variations are possible without departing from the scope of the invention as defined in the appended claims.

The invention claimed is:

1. A method of manufacturing packaging comprising the steps of:

a) providing a self-supporting, semi-rigid packaging material that is a carton-board, plastic, or a combination thereof;

b) forming score lines comprising at least one cut within the packaging material by subjecting the packaging material to laser or mechanical scoring;

c) folding the packaging material along the at least one cut and forming a longitudinal seal securing the packaging material in position to form a tubular container; and d) forming at least one end seal by folding at least a first side panel and a second side panel about a respective triangular fold line assembly to form at least one gabled end region and sealing together at least two opposing regions of the packaging material to form a partially sealed package, the at least one gabled end region being present in a finally formed package as at least one gabled end region;

e) performing at least one of steps b), c) and d) on a horizontal or vertical fill, form, and seal apparatus.

2. The method as claimed in claim 1, wherein the at least one seal comprises a fin seal formed by sealing together the at least two opposing surfaces of the packaging material.

3. The method as claimed in claim 1, further comprising crimping or embossing the at least one seal along at least a portion thereof to form patterned sealed regions of the packaging.

4. The method as claimed in claim 1, wherein the at least one seal is formed by providing an adhesive on at least a portion of at least one of the regions of the packaging material.

5. The method as claimed in claim 4, wherein the adhesive comprises a peelable or reclosable adhesive.

6. The method as claimed in claim 1, wherein at least one item is placed on an inside surface of the packaging material after step b) or is placed in the container after step c).

7. The method as claimed in claim 6, wherein the at least one item is a food item selected from a confectionery item, bakery item, fruit, vegetable, meat, cheese, powdered food, powdered beverage, and snack item.

8. The method as claimed in claim 1, wherein after performing step d) the formed package is only partially sealed and at least one item is placed into the partially sealed package.

9. The method as claimed in claim 8, wherein at least one further seal is formed after placing at least one item into the partially sealed package such that a fully sealed packaging is formed housing at least one item therein.

10. The method as claimed in claim 1, wherein the score lines are formed within the packaging material separately before loading the packaging material onto apparatus used in conventional horizontal or vertical fill, form, and seal processes.

11. The method as claimed in claim 1, wherein the score lines are formed within the packaging material during a horizontal or vertical fill, form, and seal process.

12. The method as claimed in claim 11, wherein the score lines are formed within the packaging material before an item is located on the packaging material.

13. The method as claimed in claim 11, wherein at least one score line is formed within the packaging material before an item is located on the packaging, and at least one score line is formed within the packaging material after an item is located on the packaging material.

14. The method as claimed in claim 1, wherein the packaging material comprises cartonboard.

15. The method as claimed in claim 1, wherein the packaging material has a thickness of at least 125 microns.

16. Packaging manufactured using the method as claimed in claim 1, comprising at least one set of opposing and spaced apart first and second surfaces, wherein a region of each end the first and second surfaces is sealed together.

17. The method as claimed in claim 1, further comprising the step of positioning at least one item on an inside surface of the packaging material prior to completion of at least one of steps c) and d).

18. The method as claimed in claim 1, wherein the score lines comprise the at least one cut and at least one fold line.

19. The method as claimed in claim 1, wherein the at least one gabled end region present in the finally formed package has a triangular shape.

20. The method as claimed in claim 1, wherein the at least one gabled end region is present at an exterior surface of the finally formed package.

* * * * *